US006971193B1

(12) United States Patent
Potter et al.

(10) Patent No.: US 6,971,193 B1
(45) Date of Patent: Dec. 6, 2005

(54) BLADDER WITH HIGH PRESSURE REPLENISHMENT RESERVOIR

(75) Inventors: Daniel R. Potter, Forest Grove, OR (US); David B. Herridge, Mendota Heights, MN (US)

(73) Assignee: Nike, Inc., Beaverton, OR (US)

( * ) Notice: Subject to any disclaimer, the term of this patent is extended or adjusted under 35 U.S.C. 154(b) by 198 days.

(21) Appl. No.: 10/092,873

(22) Filed: Mar. 6, 2002

(51) Int. Cl.[7] ..... A61F 5/14; A43B 13/20; A43B 19/00; A43B 7/14

(52) U.S. Cl. ..... 36/141; 36/29; 36/71; 36/153

(58) Field of Search ..... 36/141, 29, 35 B, 36/28, 30 R, 35 R, 37, 71, 153

(56) References Cited

U.S. PATENT DOCUMENTS

| | | | | |
|---|---|---|---|---|
| 900,867 | A | | 10/1908 | Miller |
| 1,069,001 | A | | 7/1913 | Guy |
| 1,240,153 | A | | 9/1917 | Olsen |
| 1,304,915 | A | | 5/1919 | Spinney |
| 1,323,610 | A | | 12/1919 | Price |
| 1,514,468 | A | | 11/1924 | Schopf |
| 1,584,034 | A | | 5/1926 | Klotz |
| 1,625,582 | A | | 4/1927 | Anderson |
| 1,625,810 | A | | 4/1927 | Krichbaum |
| 1,869,257 | A | | 7/1932 | Hitzler |
| 1,916,483 | A | | 7/1933 | Krichbaum |
| 1,970,803 | A | | 8/1934 | Johnson |
| 2,004,906 | A | | 6/1935 | Simister |
| 2,080,469 | A | | 5/1937 | Gilbert |
| 2,086,389 | A | | 7/1937 | Pearson |
| 2,269,342 | A | | 1/1942 | Johnson |
| 2,365,807 | A | | 12/1944 | Dialynas |
| 2,488,382 | A | | 11/1949 | Davis |
| 2,546,827 | A | | 3/1951 | Lavinthal |
| 2,600,239 | A | | 6/1952 | Gilberg |
| 2,645,865 | A | | 7/1953 | Town |
| 2,677,906 | A | * | 5/1954 | Reed ..... 36/153 |
| 2,703,770 | A | | 3/1955 | Melzer |
| 2,748,401 | A | | 6/1956 | Winstead |
| 2,762,134 | A | * | 9/1956 | Town ..... 36/153 |
| 3,030,640 | A | | 4/1962 | Gosman |
| 3,048,514 | A | | 8/1962 | Bentele et al. |
| 3,120,712 | A | | 2/1964 | Menken |
| 3,121,430 | A | | 2/1964 | O'Reilly |
| 3,204,678 | A | | 9/1965 | Worcester |

(Continued)

FOREIGN PATENT DOCUMENTS

| | | |
|---|---|---|
| AT | 181938 | 2/1906 |

(Continued)

OTHER PUBLICATIONS

Sports Research Review, NIKE, Inc., Jan./Feb. 1990.

(Continued)

*Primary Examiner*—Anthony Stashick
(74) *Attorney, Agent, or Firm*—Banner & Witcoff, Ltd.

(57) ABSTRACT

A shock absorbing bladder for use in the sole of an article of footwear is disclosed. The bladder includes a plurality of inflated chambers at different pressure levels. The bladder includes a first sealed chamber formed of a barrier material. The first chamber contains a fluid at a first fluid pressure. A second sealed chamber also forms part of the bladder. The second chamber is formed of a second barrier material and contains an inflation fluid at a second fluid pressure that is greater than said first fluid pressure. The second chamber is operatively coupled to the first chamber so that the inflation fluid from the second chamber moves into the first chamber to replenish fluid leaving the first chamber.

19 Claims, 9 Drawing Sheets

U.S. PATENT DOCUMENTS 3,251,076 A 5/1966 Burke
3,284,264 A 11/1966 O'Rourke
3,335,045 A 8/1967 Post
3,366,525 A 1/1968 Jackson
3,469,576 A 9/1969 Smith et al.
3,568,227 A 3/1971 Dunham
3,589,037 A 6/1971 Gallagher
3,608,215 A 9/1971 Fukuoka
3,685,176 A 8/1972 Rudy
3,758,964 A 9/1973 Nishimura
3,765,422 A 10/1973 Smith
4,017,931 A 4/1977 Golden
4,054,960 A 10/1977 Pettit et al.
4,115,934 A 9/1978 Hall
4,129,951 A 12/1978 Petrosky
4,167,795 A 9/1979 Lambert, Jr.
4,183,156 A 1/1980 Rudy
4,187,620 A 2/1980 Seiner
4,217,705 A 8/1980 Donzis
4,219,945 A 9/1980 Rudy
4,271,606 A 6/1981 Rudy
4,287,250 A 9/1981 Rudy
4,292,702 A 10/1981 Phillips
4,297,797 A 11/1981 Meyers
4,305,212 A 12/1981 Coomer
4,328,599 A 5/1982 Mollura
4,358,902 A 11/1982 Cole et al.
4,431,003 A 2/1984 Sztancsik
4,445,283 A 5/1984 Meyers
4,446,634 A 5/1984 Johnson et al.
4,458,430 A 7/1984 Peterson
4,483,030 A 11/1984 Plick et al.
4,486,964 A 12/1984 Rudy
4,506,460 A 3/1985 Rudy
4,547,919 A 10/1985 Wang
4,662,087 A 5/1987 Beuch
4,670,995 A 6/1987 Huang
4,686,130 A 8/1987 Kon
4,722,131 A 2/1988 Huang
4,744,157 A 5/1988 Dubner
4,763,426 A 8/1988 Polus et al.
4,779,359 A 10/1988 Famolare, Jr.
4,782,602 A 11/1988 Lakic
4,803,029 A 2/1989 Iversen et al.
4,817,304 A 4/1989 Parker et al.
4,823,482 A 4/1989 Lakic
4,845,338 A 7/1989 Lakic
4,845,861 A 7/1989 Moumgdgian
4,874,640 A 10/1989 Donzis
4,891,855 A 1/1990 Cheng-Chung
4,906,502 A 3/1990 Rudy
4,912,861 A 4/1990 Huang
4,936,029 A * 6/1990 Rudy ..... 36/29
4,965,899 A 10/1990 Sekido et al.
4,991,317 A 2/1991 Lakic
4,999,931 A 3/1991 Vermeulen
4,999,932 A 3/1991 Grim
5,022,109 A 6/1991 Pekar
5,025,575 A 6/1991 Lakic
5,042,176 A 8/1991 Rudy
5,044,030 A 9/1991 Balaton
5,046,267 A 9/1991 Kilgore et al.
5,083,361 A 1/1992 Rudy
5,104,477 A 4/1992 Williams et al.
5,155,927 A 10/1992 Bates et al.
5,158,767 A 10/1992 Cohen et al.
5,179,792 A 1/1993 Brantingham
5,193,246 A 3/1993 Huang
5,199,191 A 4/1993 Moumdjian
5,224,277 A 7/1993 Sang Do
5,224,278 A 7/1993 Jeon
5,228,156 A 7/1993 Wang
5,235,715 A 8/1993 Donzis
5,238,231 A 8/1993 Huang
5,245,766 A 9/1993 Warren
5,253,435 A 10/1993 Auger et al.
5,257,470 A 11/1993 Auger et al.
5,297,349 A 3/1994 Kilgore
5,335,382 A 8/1994 Huang
5,337,492 A 8/1994 Anderie et al.
5,353,523 A 10/1994 Kilgore et al.
5,355,552 A 10/1994 Huang
5,367,791 A 11/1994 Gross et al.
5,406,719 A * 4/1995 Potter ..... 36/28
5,425,184 A 6/1995 Lyden et al.
5,524,364 A 6/1996 Cole et al.
5,543,194 A 8/1996 Rudy
5,558,395 A 9/1996 Huang
5,572,804 A 11/1996 Skaja et al.
5,595,004 A 1/1997 Lyden et al.
5,625,964 A 5/1997 Lyden et al.
5,669,161 A 9/1997 Huang
5,686,167 A 11/1997 Rudy
5,704,137 A 1/1998 Dean et al.
5,713,141 A 2/1998 Mitchell et al.
5,741,568 A 4/1998 Rudy
5,753,061 A 5/1998 Rudy
5,755,001 A 5/1998 Potter et al.
5,771,606 A 6/1998 Litchfield et al.
5,802,739 A 9/1998 Potter et al.
5,813,142 A 9/1998 Demon
5,826,349 A 10/1998 Goss
5,830,553 A 11/1998 Huang
5,832,630 A 11/1998 Potter
5,846,063 A 12/1998 Lakic
5,902,660 A 5/1999 Huang
5,907,911 A 6/1999 Huang
5,916,664 A 6/1999 Rudy
5,925,306 A 7/1999 Huang
5,937,462 A 8/1999 Huang
5,950,332 A 9/1999 Lain
5,952,065 A 9/1999 Mitchell et al.
5,976,451 A 11/1999 Skaja et al.
5,979,078 A * 11/1999 McLaughlin ..... 36/29
5,987,780 A 11/1999 Lyden et al.
5,993,585 A 11/1999 Goodwin et al.
6,013,340 A 1/2000 Bonk et al.
6,027,683 A 2/2000 Huang
6,029,962 A 2/2000 Shorten et al.
6,055,746 A 5/2000 Lyden et al.
6,065,150 A 5/2000 Huang
6,085,444 A 7/2000 Cho
6,098,313 A 8/2000 Skaja
6,119,371 A 9/2000 Goodwin et al.
6,127,010 A 10/2000 Rudy
6,128,837 A 10/2000 Huang
6,158,149 A * 12/2000 Rudy ..... 36/29
6,176,025 B1 1/2001 Patterson et al.
6,321,465 B1 11/2001 Bonk et al.
6,457,263 B1 * 10/2002 Rudy ..... 36/29
6,510,624 B1 * 1/2003 Lakic ..... 36/29
6,571,490 B2 * 6/2003 Tawney et al. ..... 36/29

FOREIGN PATENT DOCUMENTS

AT 200963 12/1958
CA 727582 2/1966
DE 32 34 086 9/1982
DE 92 01 758.4 12/1992
EP 0 094 868 5/1983
EP 0 215 974 A1 9/1985
EP 0 605 485 B1 9/1992
EP 0 780 064 A2 12/1996
FR 1195549 11/1959

| | | | | |
|---|---|---|---|---|
| FR | 1406610 | 11/1965 | | |
| FR | 2144464 | 1/1973 | | |
| FR | 2404413 | 4/1979 | | |
| FR | 2407008 | 5/1979 | | |
| FR | 2483321 | 4/1981 | | |
| FR | 2614510 | 4/1987 | | |
| FR | 2639537 | 11/1988 | | |
| GB | 14955 | 8/1893 | | |
| GB | 7441 | 3/1906 | | |
| GB | 233387 | 1/1924 | | |
| GB | 978654 | 12/1964 | | |
| GB | 1128764 | 10/1968 | | |
| JP | 266718 | 9/1992 | | |
| JP | 6-181802 | 7/1994 | | |
| TW | 75100322 | 1/1975 | | |
| TW | U 54221 | 6/1978 | | |
| WO | WO89/10074 | 11/1989 | | |
| WO | WO90/10396 | 9/1990 | | |
| WO | WO91/11928 | 8/1991 | | |
| WO | WO91/11931 | 8/1991 | | |
| WO | WO92/08384 | 5/1992 | | |
| WO | WO 93/12685 A1 * | 7/1993 | ..... | A43B 13/20 |
| WO | WO95/20332 | 8/1995 | | |
| WO | WO98/09546 | 3/1998 | | |

OTHER PUBLICATIONS

Brooks Running Catalog, Fall 1991.

Vernay Laboratories—Check Valves, Engineering Fluid Control.

* cited by examiner

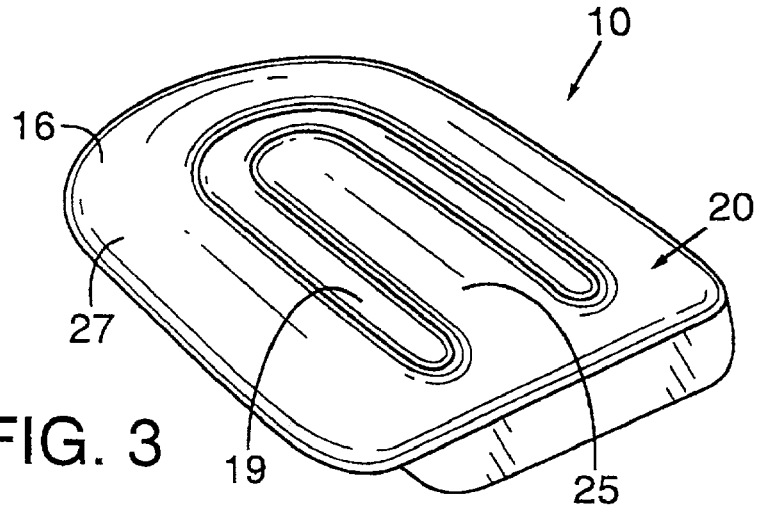
FIG. 3
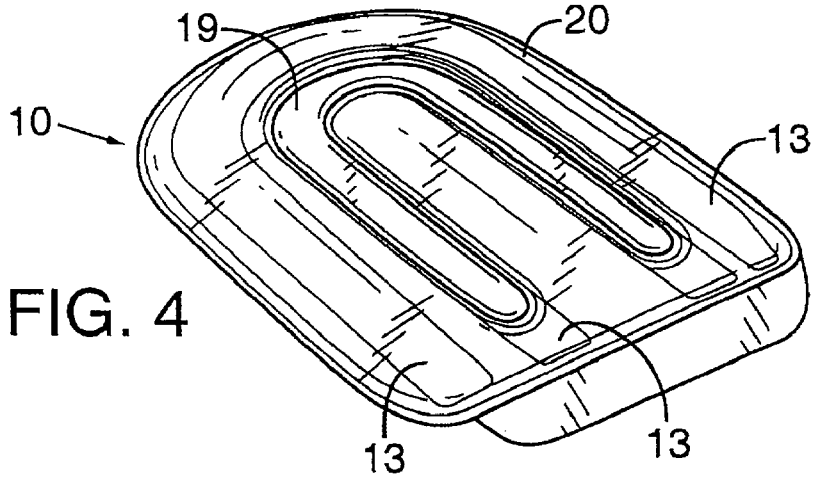
FIG. 4
FIG. 5
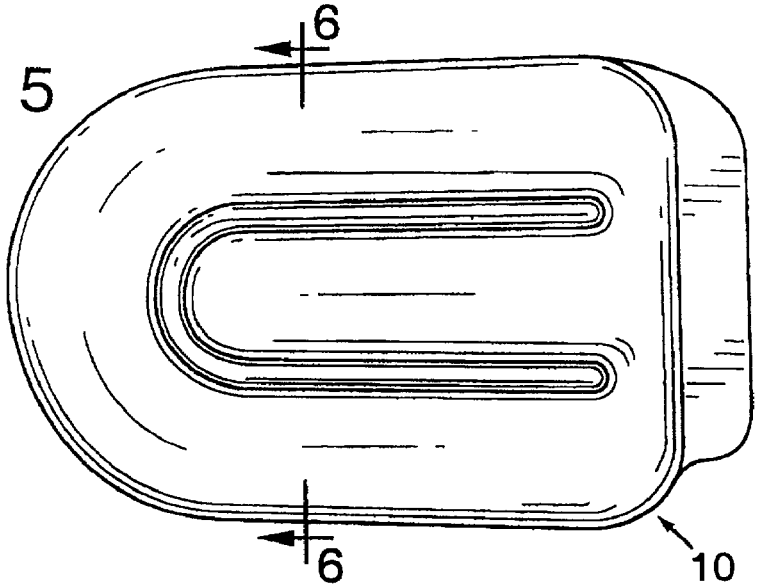

FIG. 6
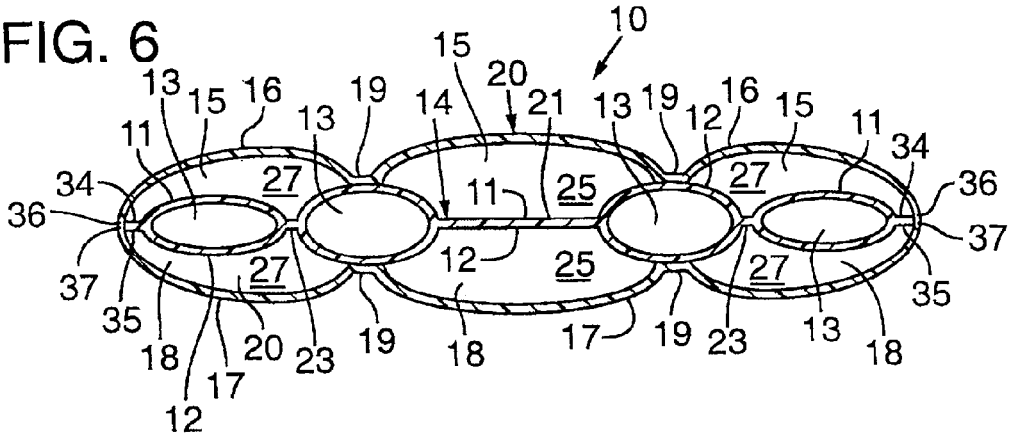
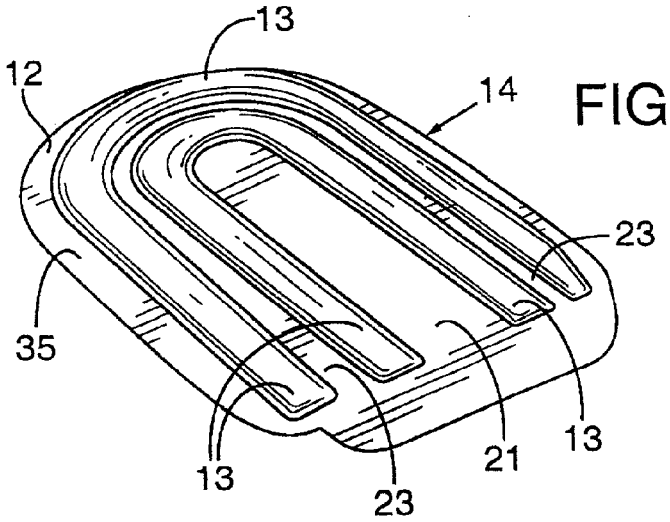
FIG. 7
FIG. 8
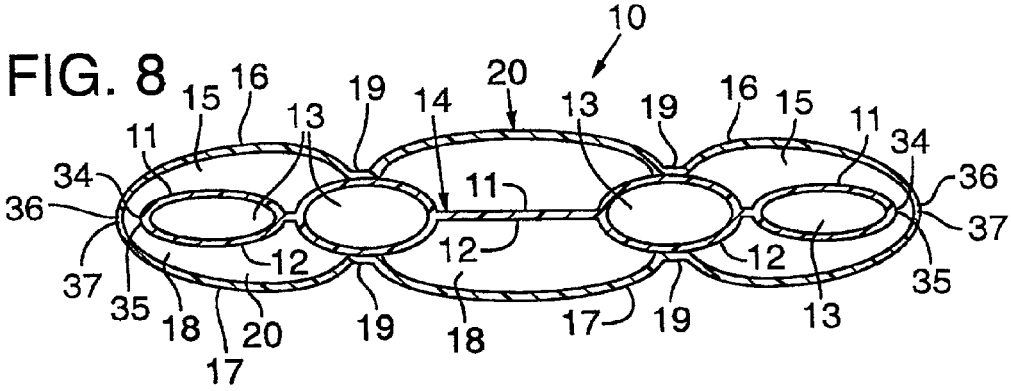

BLADDER WITH HIGH PRESSURE REPLENISHMENT RESERVOIR

BACKGROUND OF THE INVENTION

1. Field of the Invention

The present invention relates to an improved cushioning member for an article of footwear, and more particularly to a fluid filled bladder having multiple, fluid containing chambers of differing pressures including at least one reservoir chamber for maintaining predetermined pressure levels within the bladder.

2. Description of Background Art

Footwear includes two main portions, an upper and a sole unit. The upper is designed to comfortably enclose at least a portion of the foot. The sole unit typically includes a midsole for absorbing the harmful impact forces created during a foot strike in order to prevent injury to the wearer. The sole unit also includes an outsole for providing traction. Some midsoles include a plurality of layers of different, resilient cushioning materials. However, over time, these midsoles break down and loose their ability to effectively cushion against the jarring forces that result from a foot strike, particularly midsoles using foam materials, such as polyurethane foam or ethyl vinyl acetate (EVA) foam. Breakdown of the cushioning material can be accelerated when the midsole is exposed to repeated heavy loads during use.

Other conventional midsoles include layers of cushioning materials combined with at least one resilient cushioning element for increased and longer lasting cushioning. One type of known cushioning element contains a cushioning fluid or gel and is commonly referred to as a bladder. However, the bladder containing midsoles can also experience cushioning breakdown. Compared to the well known, resilient midsole materials, it takes longer for the shock absorbing properties of a gas containing bladder to diminish. For example, diffusion can cause a gas containing bladder to lose pressure over time. This loss of cushioning is magnified when a heavy load is applied or when the footwear is used over an extended period of time. While recent developments in materials have improved gas filled bladders, problems still exist with their durability and the effective life span.

Some bladders rely on "diffusion pumping" to increase or maintain a level of pressure and cushioning within their barrier walls. Diffusion pumping is discussed in U.S. Pat. No. 4,340,626 to Rudy which is hereby incorporated by reference. Diffusion pumping can occur when the gas used for inflating an elastomeric, pneumatic bladder is different from the ambient air surrounding the bladder, or it is at least partly different from the ambient air surrounding the bladder. The inflating gas, such as a large molecule "supergas," discussed below, exhibits very low permeability and an inability to diffuse readily through the elastomeric barrier walls of the bladder. As a result, the pressure within the bladder increases when it is surrounded by ambient air. This is due to the nitrogen, oxygen and argon from the ambient air diffusing through the barrier material into its interior while the supergas remains within the bladder, thereby increasing the pressure within the bladder. The inward diffusion continues until the partial pressure of air in the enclosure equals the atmospheric pressure outside the enclosure. The resulting total pressure within the enclosure is the sum of the partial pressure of the diffused air within the enclosure combined and the pressure of the initial supergas.

Relying on diffusion pumping from only the outside environment is not a very accurate way to re-establish or maintain a predetermined level of pressure within a bladder. Inward diffusion from an uncontrolled environment does not allow for an accurate control of the inflation rate and the final internal pressure. Moreover, diffusion pumping will occur when it is not needed. Whether it is desired or not, diffusion pumping will only end when the partial pressure of the diffused air within the bladder is equal to the pressure of the air surrounding it. Diffusion pumping does not allow for controlled, on demand replenishing of pressure within the bladder to a predetermined pressure. Also, diffusion pumping does not allow the controlled diffusion of a preselected gas from an internal bladder chamber to an external bladder chamber at a predetermined rate. Similarly, diffusion pumping will not provide a substantially instantaneous increase in fluid pressure in response to the application of a heavy load. As a result, the pressure within conventional bladders cannot be altered in a short period of time, in response to a specific load or for customizing the bladder to the needs of the user.

Some prior art footwear use external inflation pumping devices to increase the pressure within their bladders. These devices typically include hand pumps or pressurized gas canisters connected to the bladder through channels extending within the footwear. Inflation pumping devices are used on a random basis, at preselected intervals or when a loss in pressure is perceived. If used at random or preselected times, the user can over pressurize the bladder and compromise its cushioning ability. Alternatively, if the user waits until a perceptible loss in pressure exists, he risks becoming injured as a result of using footwear with little or no effective cushioning.

Locating the gas source outside of the footwear makes instantaneous re-pressurization of the bladder during use impossible. In addition, prior art pumping devices do not instantaneously re-pressurize the bladder when a predetermined level of force is created within the bladder or after the bladder has been fatigued a predetermined amount. Instead, re-pressurization only occurs when the user chooses to operate the pumping device. Also, many external pressure devices lack a pressure gauge. As a result, it is difficult to control the final, effective pressure within the bladder when an external inflation pumping device is used.

In addition to the above drawbacks, an external inflation device is not a practical way of restoring pressure to a bladder when the footwear is being used. In order to replenish the pressure within a bladder, the wearer must stop his activity, locate the inflation pumping device, connect it to the bladder and begin pumping gas into the bladder chambers. Moreover, in order to use these devices, a wearer must carry the cumbersome inflation device with him during his run or activity. If the user does not carry the inflation device, he will not be able to restore pressure to the bladder as needed and could sacrifice cushioning and energy return if the bladder required replenishing.

It is an object of the present invention to provide a fluid containing bladder that overcomes the deficiencies of the prior art.

It is also an object of the present invention to provide a fluid containing bladder having a plurality of chambers with at least one of the chambers containing a reservoir of fluid for replenishing the other chambers. It is further an object to control the amount of fluid and the timing of its transfer from the reservoir chamber to the other chambers within the bladder.

BRIEF SUMMARY OF THE INVENTION

The present invention relates to a shock absorbing bladder for use in the sole of an article of footwear. The shock absorbing bladder includes a plurality of inflated chambers at different pressure levels. The bladder includes a first sealed chamber formed of a barrier material. The first chamber contains a fluid at a first fluid pressure. A second sealed chamber also forms part of the bladder. The second chamber is formed of a second barrier material and contains an inflation fluid at a second fluid pressure that is greater than said first fluid pressure. The second chamber is operatively coupled to the first chamber so that the inflation fluid from the second chamber moves into the first chamber as it leaves the second chamber. This results in an increase in fluid and fluid pressure within the first chamber.

The second chamber can also include a plurality of reservoir chambers that act as fluid reservoirs for restoring pressure and maintaining the cushioning capability of the surrounding chambers. The reservoir chambers can be formed of a barrier material that allows its contained gas to diffuse out into the surrounding chamber or chambers at a predetermined diffusion rate after the pressure in the surrounding chambers drops below a predetermined level. The reservoir chamber can also be formed of a barrier material that ruptures under the application of a predetermined load being applied to the reservoir chamber or as the result of fatigue of the chamber walls over a predetermined period of time or amount of use. The high pressure reservoir chambers may be positioned within the bladder so that they are not in the areas of highest impact during a foot strike.

The present invention provides a cushioning bladder having a reservoir system that maintains the cushioning pressure level within the bladder above a predetermined level in order to reduce the risk of injury to the user. Additionally, the cushioning pressure level within the bladder can be re-established before the wearer notices the need and without the use of external tools. The fluid within the second chamber(s) is released into the first chamber in response to conditions occurring within the bladder.

BRIEF DESCRIPTION OF THE DRAWINGS

FIG. 3 is a top perspective view of the bladder shown in FIG. 2;

FIG. 4 is a top perspective view of the bladder shown in FIG. 2 with a transparent outer surface;

FIG. 5 is a top plan view of the bladder shown in FIG. 2;

FIG. 6 is a cross section of the bladder shown in FIG. 5 taken along the line 6—6 of FIG. 5;

FIG. 7 is a perspective view of the reservoir chamber of the bladder shown in FIG. 2;

FIG. 8 is a cross section of a second embodiment of a bladder according to the present invention taken along the same line as line 6—6 of FIG. 5;

DETAILED DESCRIPTION OF THE INVENTION

Figure 1:
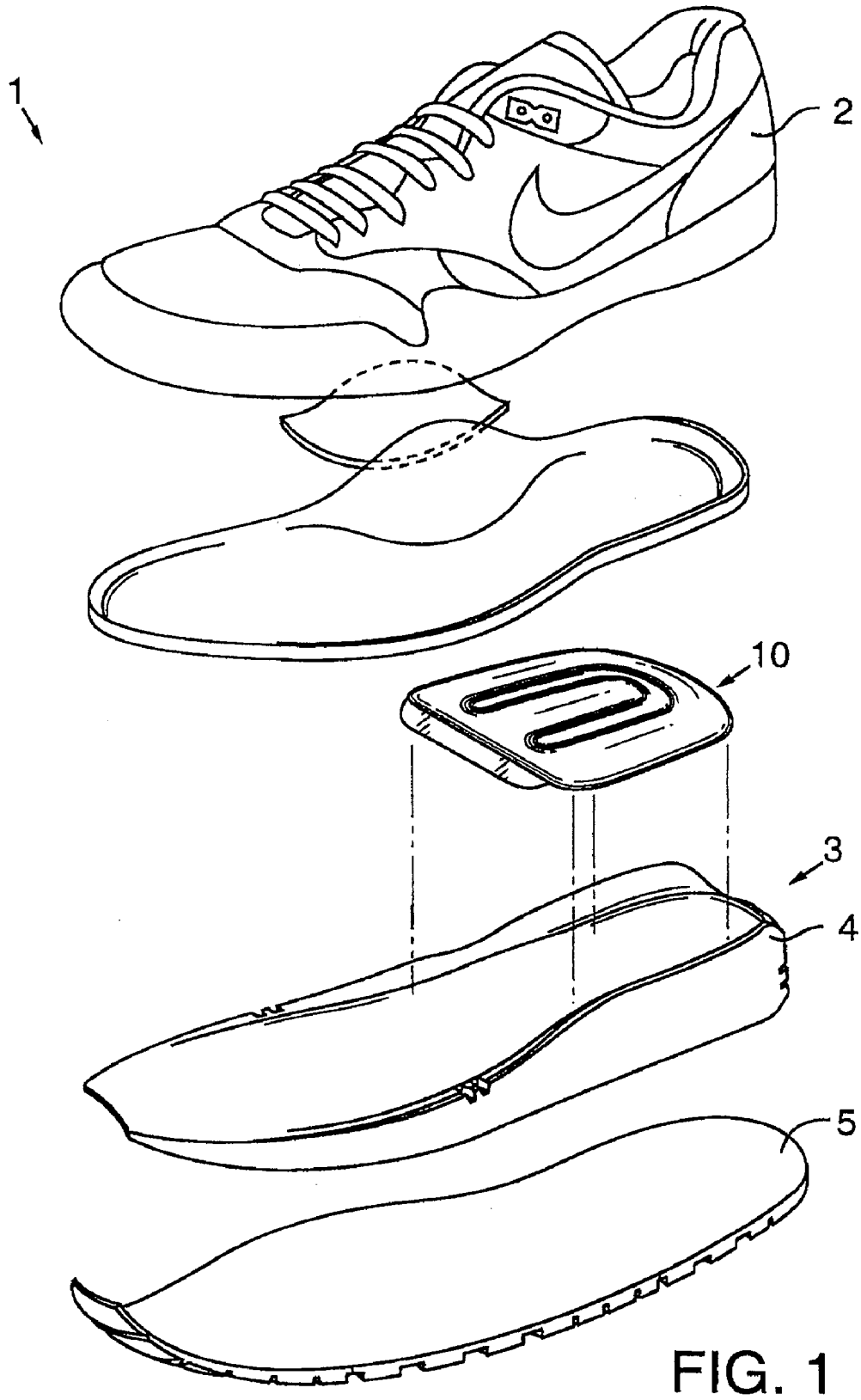
FIG. 1 is an exploded view of an article of footwear including a bladder according to a first embodiment of the present invention.

The present invention relates to a shock absorbing bladder 10 for use in an article of footwear 1. The footwear includes an upper 2 for comfortably securing the footwear 1 about the foot of a wearer. Footwear 1 also includes a sole unit 3 having a midsole 4 into which bladder 10 is incorporated and a ground engaging outsole 5 covering at least a part of the lower portion of the midsole for providing traction.

Figure 2:
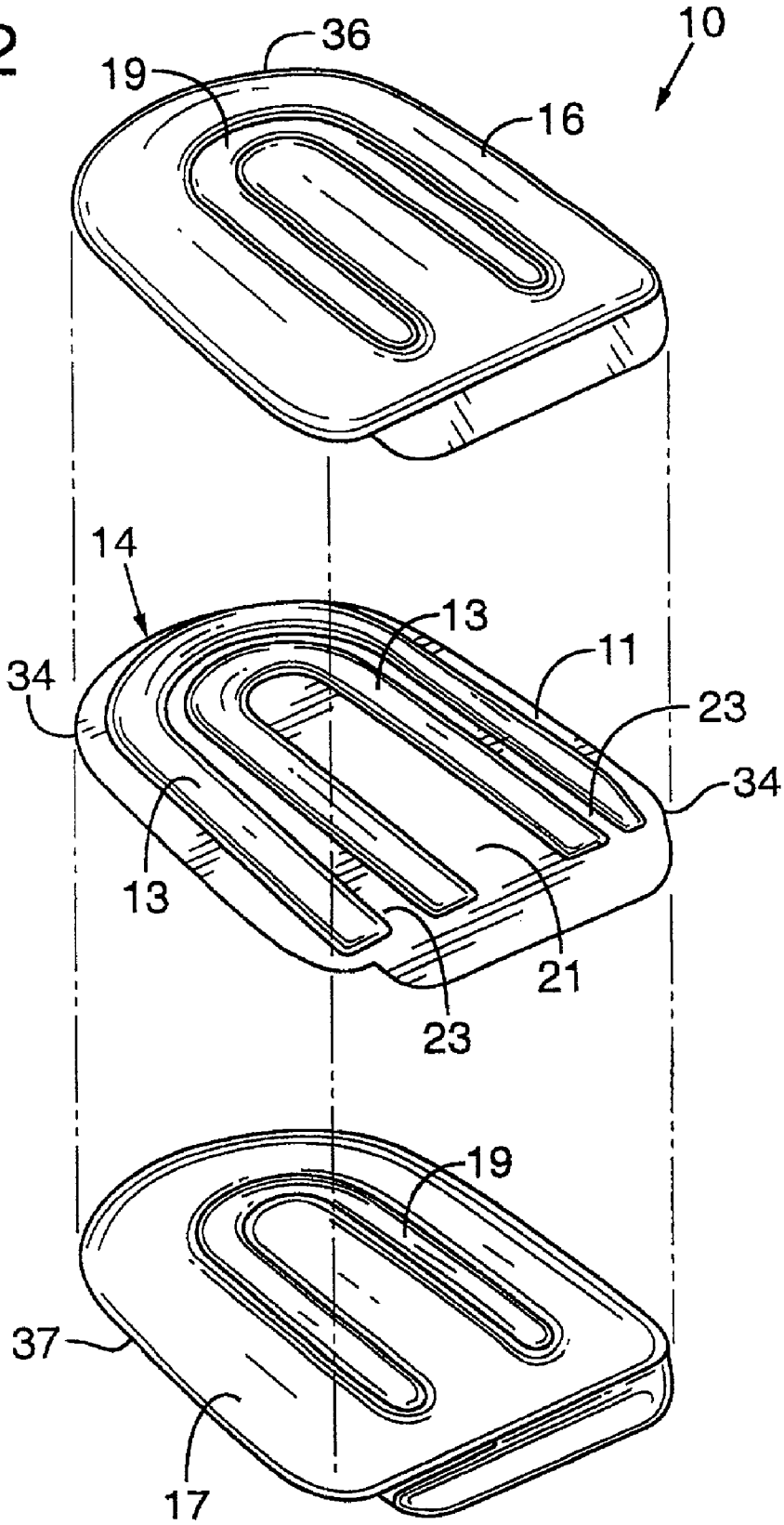
FIG. 2 is an exploded view of the bladder shown in FIG. 1.

As shown in FIGS. 2 and 6, bladder 10 includes at least four sheets of the same or different barrier materials. Bladder 10 includes a first barrier sheet 11 extending coextensive with and sed to a second barrier sheet 12. Sheets 11 and 12 are secured to each other along their peripheral edges 34, 35, along a central area 21, and along a U-shaped area 23 using RF welding and other well known securing techniques. In this manner, a reservoir insert 14, including two U-shaped channels or chambers 13 are formed.

Bladder 10 also includes third and fourth barrier sheets 16, 17, respectively. Sheet 16 covers the first sheet 1, and sheet 17 covers second sheet 12. In a first embodiment, sheets 16 and 17 are welded directly to inner sheets 11, 12, respectively, along a U-shaped weld or connection area 19. Peripheral edges 36, 37 of sheets 16, 17 are also operatively secured to each other and to peripheral edges 34, 35 of sheets 11, 12 when inner sheets 11 and 12 are welded together. Alternatively, as shown in FIG. 8, peripheral edges 36, 37 of sheets 16 and 17 are spaced away from peripheral edges 34, 35. In this alternative embodiment, sheets 16 and 17 are secured directly to each other so that edges 36 and 37 move independent of edges 34, 35 to provide a more flexible bladder 10. As with sheets 11, 12, outer sheets 16 and 17 are operatively secured to each other and to sheets 11, 12, using well known techniques such as RF welding.

An outer fluid receiving, cushioning member 20 thus surrounds reservoir insert 14 and provides the initial cushioning during a foot strike. Cushioning member 20 includes a first outer cushioning chamber 15 and a second outer cushioning chamber 18. Connection area 19 divides each chamber 15, 18 into a central chamber 25 and a U-shaped chamber 27. Each chamber 15, 18 is positioned on a respective side of insert 14 and is formed when barrier sheets 16 and 17 are secured to barrier sheets 11 and 12. Because of the connection of the peripheral edges of sheets 11, 12, 16, and 17 to one another, chambers 15 and 18 are isolated from each other so that they are not in fluid communication. However, as shown in FIG. 8, chambers 15 and 18 can be formed by directly securing peripheral edges 36 and 37 to each other so that they are spaced away from peripheral edges 34 and 35. In this alternative embodiment, chambers 15 and 18 are in fluid communication with each other and their shared fluids surround inner reservoir insert 14.

Outer chambers 15 and 18 include a gaseous cushioning fluid, for example, hexafluorethane, sulfur hexaflouride ("supergas"), or one of the other suitable gases which are identified in U.S. Pat. Nos. 4,183,156, 4,219,945, 4,936,029, and 5,042,176 to Marion F. Rudy, incorporated herein by reference. Bladder chambers 15 and 18 can also be inflated with air, nitrogen, or other gases for example in the manner set forth in the '029 Rudy patent, U.S. Pat. No. 5,713,141 to Mitchell et al, and U.S. Pat. Nos. 6,082,025 and 6,013,346 to Bonk et al. Chambers 15 and 18 are inflated to a predetermined pressure such as 5, 15 or 25 PSI for providing a desired cushioning affect to a specific portion of the footwear. Chambers 15 and 18 can be inflated to the same or different pressures depending on the type and amount of cushioning needed in the portion of the footwear where bladder 10 is positioned. Adjacent channels 25 and 27 of the same chamber 15 or 18 can also be inflated to different pressures, provided provision is made to divide the channels into two separate channels that are not in fluid communication with each other.

The material forming barrier sheets 16 and 17 may be, for example, a film formed of alternating layers of thermoplastic polyurethane and ethylene-vinyl alcohol copolymer, as disclosed in U.S. Pat. Nos. 5,713,141 and 5,952,065 to Mitchell et al., incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized for the barrier sheets. Another suitable material is a flexible microlayer membrane that includes alternating layers of a gas barrier material and an elastomeric material, as disclosed in U.S. Pat. Nos. 6,082,025 and 6,127,026 to Bonk et al., hereby incorporated by reference. Other suitable thermoplastic elastomer materials or films include polyurethane, polyester, polyester polyurethane, polyether polyurethane, such as cast or extruded ester-based polyurethane film having a shore "A" hardness of 85–90, e.g., Tetra Plastics TPW-250. Additional suitable materials are disclosed in U.S. Pat. Nos. 4,183,156 and 4,219,945 to Rudy. Among the numerous thermoplastic urethanes that are useful in forming the film sheets are urethanes such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed. Nitrogen blocking barrier materials may also be utilized and include PVDC, also known as SURAN; nylon; EVOH; and PVDF, also known as KYNAR. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., hereby incorporated by reference.

The barrier materials forming sheets 16 and 17 contain the cushioning gases within chambers 15 and 18. However, overtime and under heavy loads, some of the contained gas will diffuse out of these chambers through sheets 16 and 17, thereby causing a loss in pressure and a loss of cushioning. Inner cushioning insert 14 counters this loss of cushioning fluid. Cushioning insert 14 performs a dual function within bladder 10. It acts as a reservoir for restoring gas and pressure to the outer chambers 15, 18 so that the cushioning properties of bladder 10 are not compromise during the life of the footwear, and it provides an additional layer of cushioning that prevents bladder 10 from bottoming out when heavy loads are applied.

The inner cushioning insert 14 is formed when sheets 11 and 12 are welded together, as discussed above. As illustrated in the figures, insert 14 includes fluid channels 13 that are formed in insert 14 by welding sheets 11 and 12 together at points spaced inwardly from peripheral edges 34, 35. While channels 13 are illustrated isolated from one another, they can be in fluid communication. Channels 13 are inflated to a higher pressure than chambers 15 and 18 so that diffusion only occurs in one direction, from insert 14 into chambers 15, 18. Because insert 14 acts as a gas reservoir for chambers 15 and 18, the gas contained within channels 13 moves into chambers 15 and 18 to restore or maintain the originally established pressure levels for cushioning a foot strike. Insert 14 typically contains nitrogen at a pressure between 40 and 60 PSI with a preferred range being between 45 and 50 PSI when sheets 11 and 12 are formed from urethane based materials. However, higher pressures can be used depending on the barrier materials chosen for sheets 11 and 12. It is contemplated that one of the supergases discussed above could be used in place of nitrogen.

The materials forming inner sheets 11, 12 allow the gas contained within inner insert 14 to move into outer chambers 15, 18 in response to certain preselected conditions. These conditions include the gradual loss of pressure over time, the application of a predetermined load and the use of the bladder for a predetermined period of time. The materials are selected, in part, based on their Gas Transmission Rate (GTR). The GTR reflects the amount of gas that diffuses through a barrier material having a specific thickness over a specific period of time. GTR is a constant that varies with the thickness of the material. The GTR changes as the thickness of the material changes. Because the desired pressure level in chambers 15 and 18 can differ, the GTR of sheets 11 and 12 can also differ.

In a preferred embodiment, sheets 11 and 12 are chosen so that their GTR allows the gas from channels 13 to diffuse into chambers 15 and 18 at the same rate or substantially the same rate as the gases diffuse out of chambers 15 and 18. One preferred combination of materials and gases would use a standard urethane film for sheets 16 and 17 forming outer chambers 15 and 18, with outer chambers 15 and 18 containing nitrogen at 15 PSI; and an EVOH material for sheets 11 and 12 forming inner reservoir inserts 14, with nitrogen at 50 PSI being contained in insert 14. As a result, the gas from channels 13 diffuses into chambers 15 and 18 until the pressure within all the inserts 14 and the chambers 15 and 18 is equal to or has reached a predetermined level. Routine testing can be done with the barrier materials and gases to arrive at an appropriate diffusion from channels 13 into chambers 15 and 18. The reservoir function of inner insert 14 can extend the life of bladder 10 as an effective cushioning element for a significant period of time, as much as two or more years, when compared to a conventional cushioning bladder.

In another embodiment of the present invention, the cushioning pressure is restored within chambers 15 and 18 when insert 14 fails. This is accomplished by forming insert 14 with sheets 11, 12 that fail when a load applied to bladder 10 causes a predetermined internal pressure within insert 14. When the predetermined pressure level within insert 14 is reached, sheets 11 and 12 will fail and the fluid within insert 14 will enter chambers 15 and 18 to restore the original level of cushioning pressure, which can be in the range of 5 to 25 psi, preferably 15 psi, or establish a new level of cushioning pressure within chambers 15 and 18, up to as high as 50 psi. Sheets 11 and 12 can include a preformed material weakness or they can be formed of a material that is more brittle than sheets 16 and 17. After sheets 11 and 12 fail, the newly established pressure levels within chambers 15 and 18 can be greater than the original pressure levels. In this embodiment, the materials used for sheets 11 and 12 would include thin material with low elasticity. It is preferred that the material allow no outward diffusion of the contained gas prior to its rupture, or at least that the material have a low rate of diffusion. Thin and elastic material is not preferred since such material would allow the inner chamber to grow under high pressure. As with the above discussed embodiment, the gas contained within channels 13 is preferably nitrogen and the gas in chambers 15 and 18 is preferably nitrogen, but can be air or a supergas.

In another fatigue related embodiment, sheets 11 and 12 are formed of a material that fails after being used for a predetermined period of time. For instance, these sheet may be formed of a material that fails after the bladder has been flexed one hundred thousand (100,000) times or after three (3) months of use. In this embodiment, sheets 11 and 12 are thinner and more brittle than sheets 16 and 17. One preferred material would be Saran (PVDC). In general, the material should have less elasticity and less flex resistance, and have a high crystalline content. Failure can also be built into the inner chamber through the use of weak welds. As with the previous embodiment, the gas within insert 14 is transferred to chambers 15 and 18 when sheets 11 and 12 fail in order to increase the pressure within these chambers and restore their ability to cushion during a foot strike.

Figure 17:
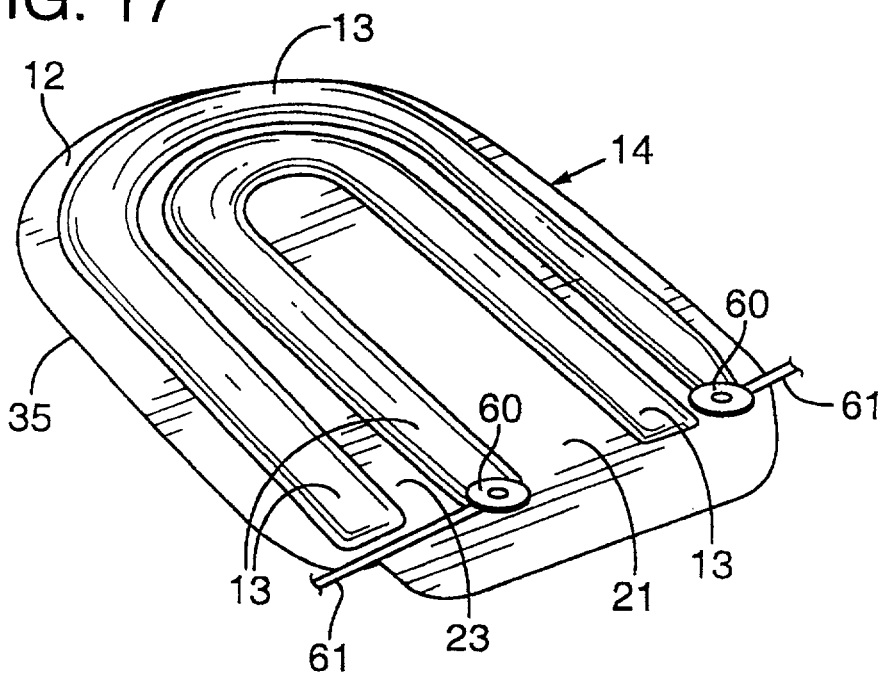
FIG. 17 is a perspective view of a reservoir chamber with a valve and actuator.
Figure 18:
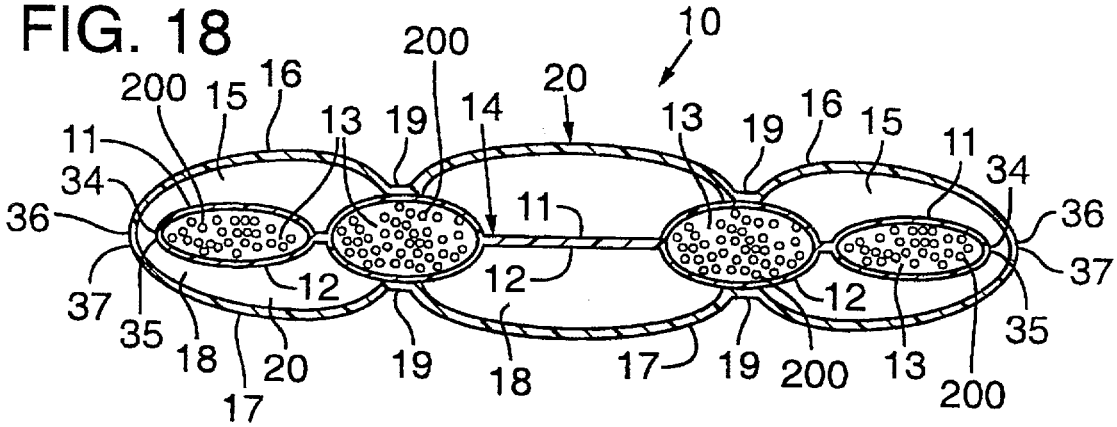
FIG. 18 is a cross-section of a fifth embodiment of the present invention taken along the same line 6—6 of FIG. 6, incorporating gas-filled pellets.
Figure 19:
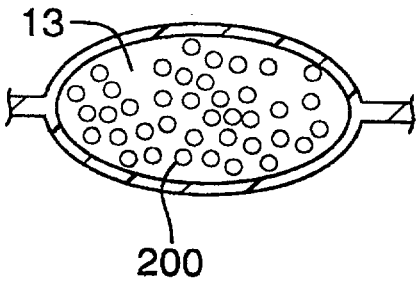
FIG. 19 is an enlarged cross-section of a single pellet containing chamber in FIG. 18.
Figure 20:
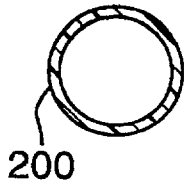
FIG. 20 is an enlarged cross-section of a single gas-filled pellet.
Figure 21:
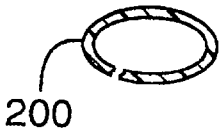
FIG. 21 is an enlarged cross-section of a single, ruptured gas-filled pellet.

The fluid contained within insert 14 can also be released into chambers 15 and 18 by manual activation. As seen in FIG. 17, one way valves 60 can be positioned within each channel 13 of insert 14 for allowing fluid to flow from insert 14 into chambers 15 and 18. An actuator 61 is positioned on an exterior surface of footwear 1 for opening and closing each valve 60 so that a controlled amount of fluid is transferred from insert 14 to chambers 15 and 18. Actuator 61 can release only a portion of the fluid within insert 14 at a given time. Alternatively, actuator 61 can include a sharp end that punctures insert 14 in multiple locations so the fluid within insert 14 is released into chambers 15 and 18. Any conventional valve can be used for valves 60, with suitable values disclosed in U.S. Pat. No. 5,253,435 to Auger et al., which is incorporated by reference.

Figure 9:
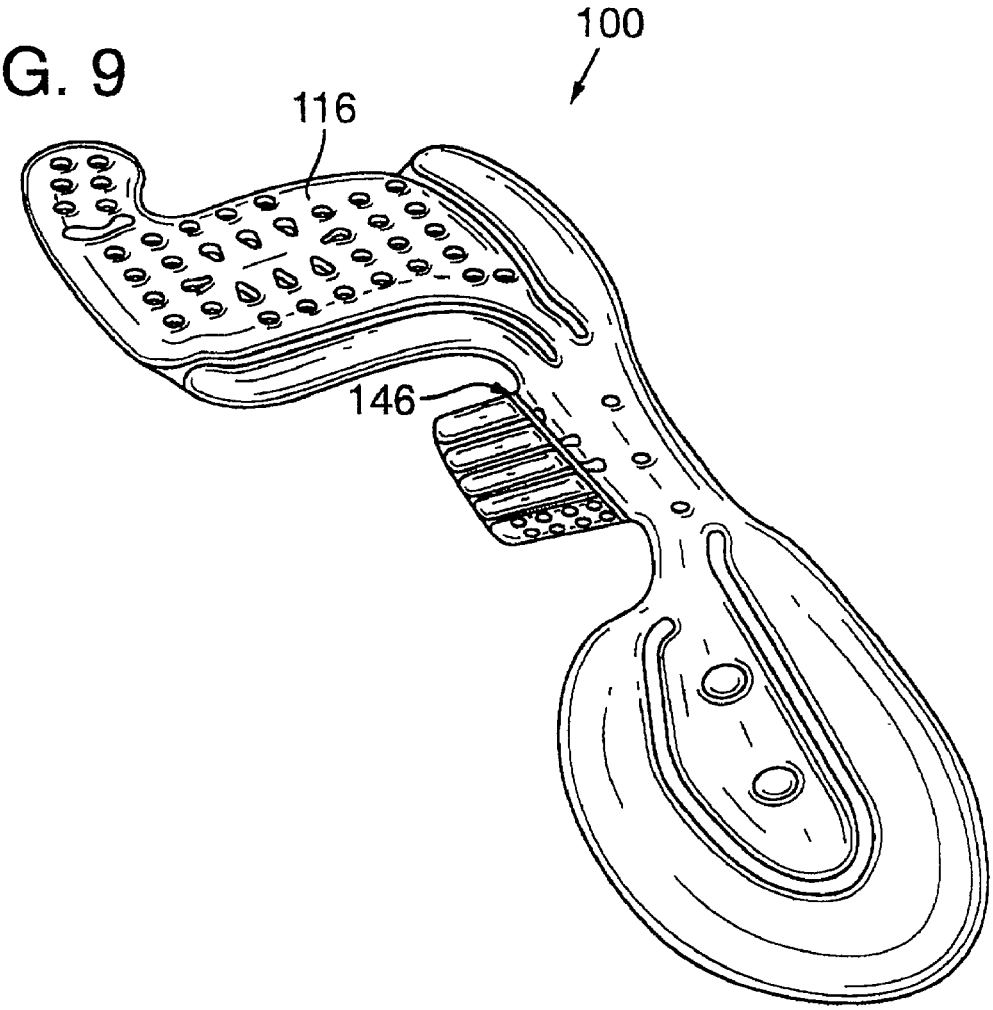
FIG. 9 is a perspective view of a third embodiment of a bladder according to the present invention.
Figure 10:
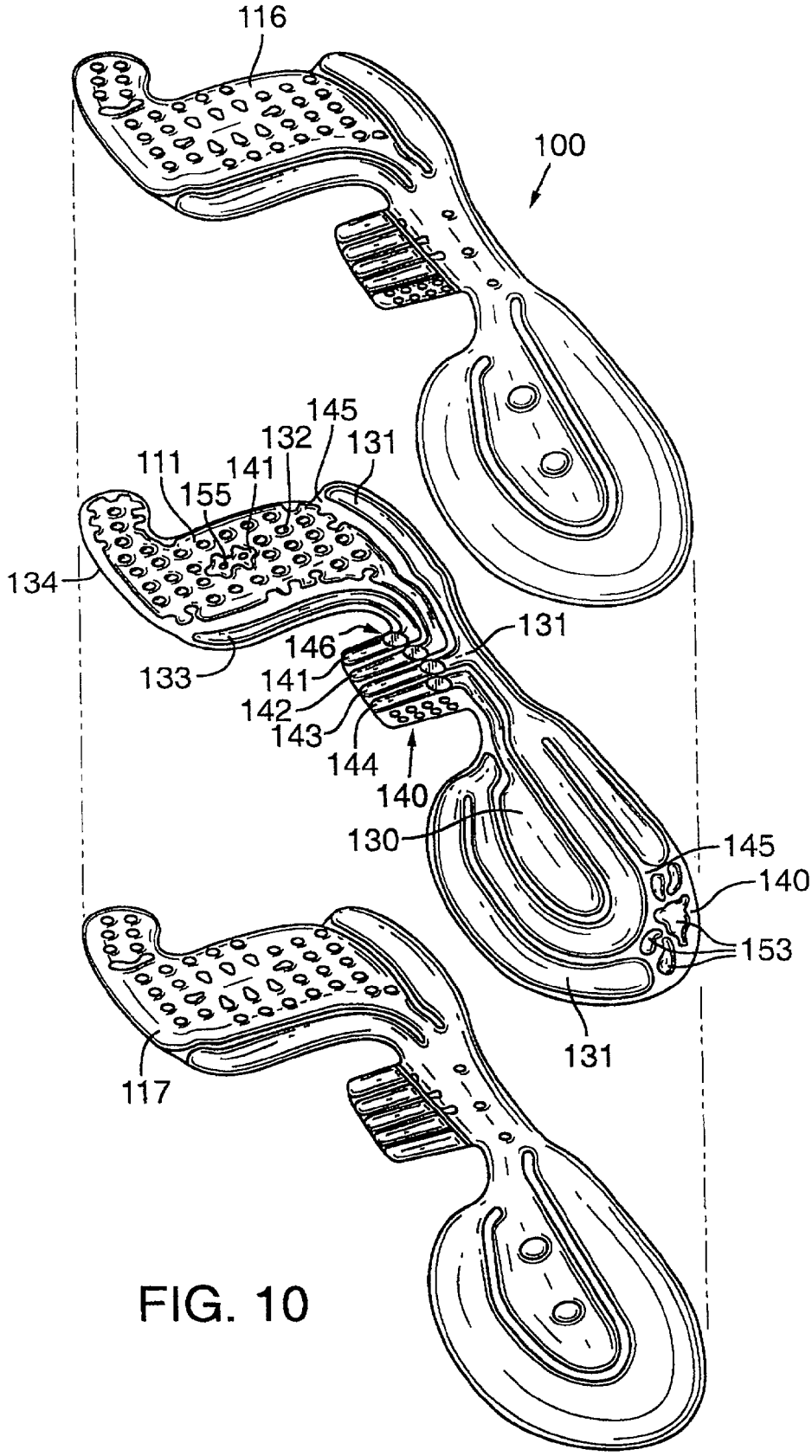
FIG. 10 is an exploded view of the bladder shown in FIG. 9.
Figure 11:
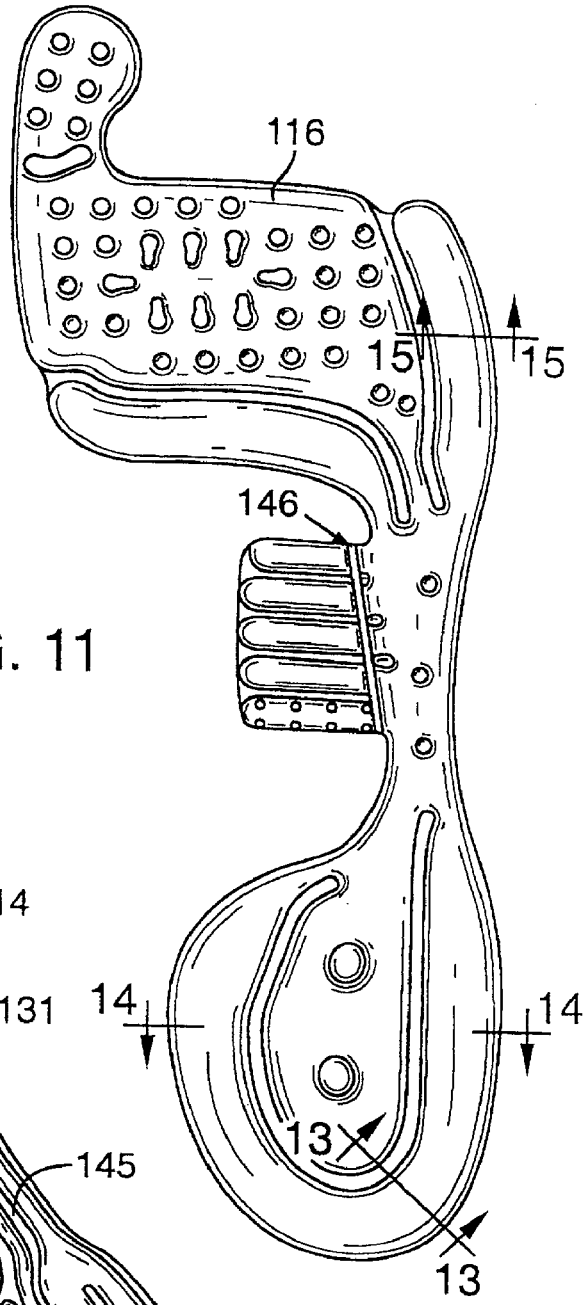
FIG. 11 is a top plan view of the bladder shown in FIG. 9.
Figure 12:
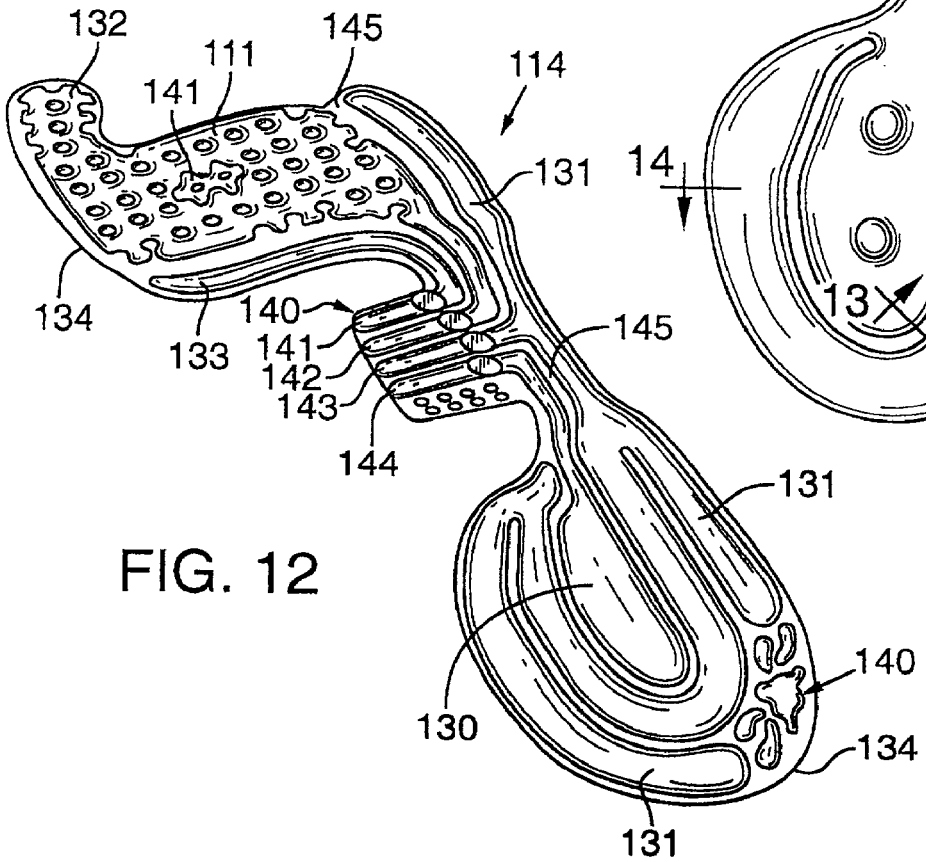
FIG. 12 is a perspective view of the reservoir chamber of the bladder shown in FIG. 9.
Figure 13:
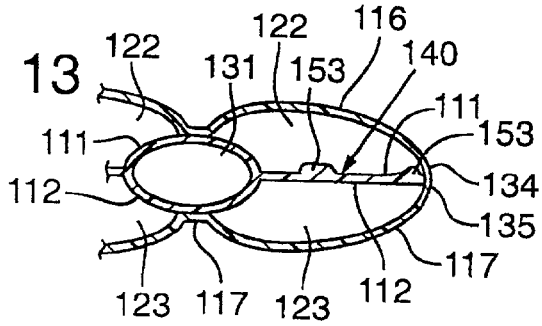
FIG. 13 is a cross section of the bladder of FIG. 9 taken along the line 13—13 in FIG. 11.
Figure 14:
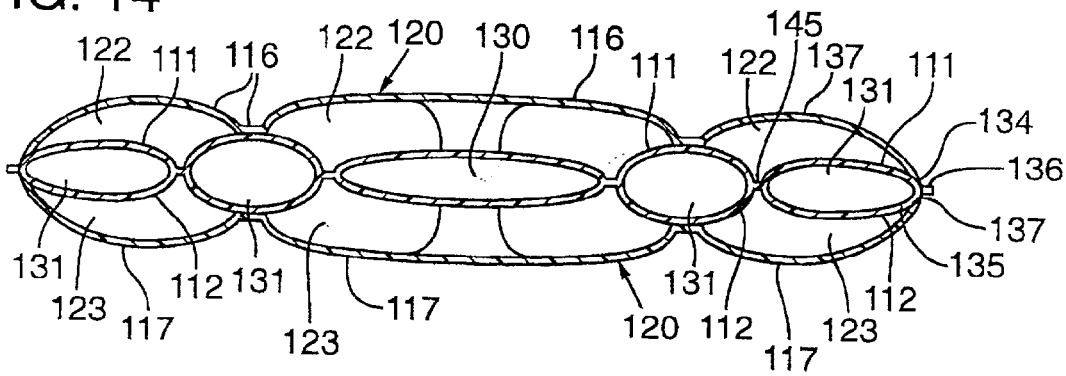
FIG. 14 is a cross section of the bladder of FIG. 9 taken along the line 14—14 in FIG. 11.
Figure 15:
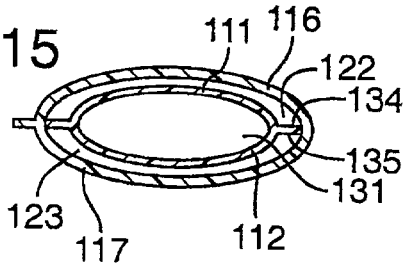
FIG. 15 is a cross section of the bladder of FIG. 9 taken along the line 15—15 in FIG. 11.
Figure 16:
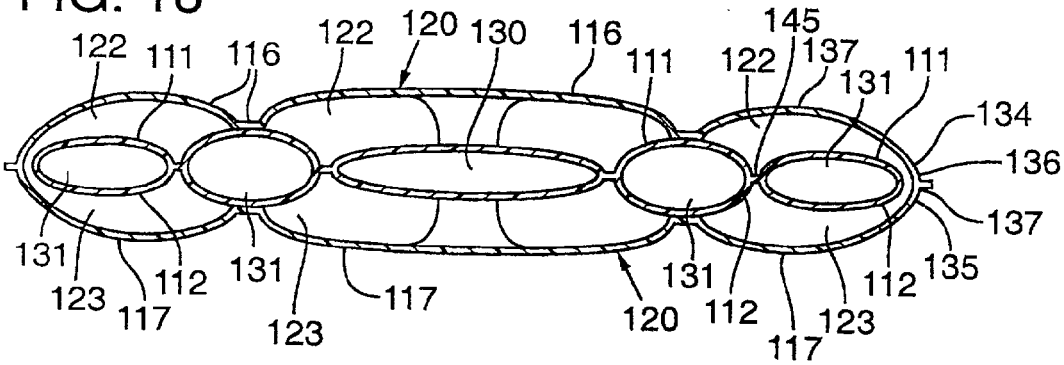
FIG. 16 is a cross section of a bladder according to a fourth embodiment of the present invention taken along the same line as line 13—13 of FIG. 11.

Another embodiment according to the present invention is shown in FIGS. 9–15. As shown in FIG. 9, a bladder 100 can be formed to extend along the length of a midsole. Full length bladder 100 includes four barrier sheets 111, 112, 116, 117. First barrier sheet 111 and second barrier sheet 112 are secured together along their peripheral edges 134, 135, respectively, as discussed above with respect to sheets 11 and 12. As discussed above with respect to sheets 16 and 17, sheets 116 and 117 cover sheets 111 and 112, respectively, when bladder 100 is assembled. The peripheral edge 136 of sheet 116 is secured to sheet 111 and the peripheral edge 137 of sheet 117 is secured to sheet 112 using well known techniques as previously discussed. In an alternative embodiment, peripheral edges 136 and 137 are secured to each other and peripheral edges 134 and 135 are spaced inwardly therefrom for increasing the flexibility of bladder 100 by eliminating the need for peripheral edges 134 and 135 to move each time peripheral edges 136 and 137 move.

A fluid chamber 114 having multiple fluid channels 130–133 is formed when inner sheets 111 and 112 are secured together along their peripheral edges 134, 135 and at locations 145 spaced inwardly from these edges. Channels 130–133 are positioned throughout full length bladder 100 for providing cushioning to the entire foot. An outer cushioning member 120 is formed around inner chamber 114, and includes two non-communicating chambers 122 and 123, each located on one side of inner chamber 114. As with member 20, member 120 provides cushioning during a foot strike. Chambers 122 and 123 are separated by the peripheral edge welds that secure sheets 111, 112, 116, 117 together. Alternatively, when sheets 116 and 117 are directly secured together, and peripheral edges 134, 135 of inner sheets 111 and 112 are positioned inwardly from the peripheral edges 136, 137, chambers 122 and 123 are in fluid communication with each other and their shared cushioning fluid surrounds inner chamber 114.

Inner channels 130–133 are inflated with a gas such as those discussed above with respect to insert 14. In a preferred embodiment, the gas is nitrogen and the chambers are inflated to a pressure between 40 and 60 PSI, with a preferred pressure being about 50 PSI. Like channels 13, inner channels 130–133 perform a dual function, they provide a second layer of cushioning and act as a reservoir for replenishing the fluid pressure within chambers 122 and 123. Each channel 130–133 is inflated using a respective inflation port 141–144 in an inflation region 140.

The ports 141–144 are positioned so that they can each be individually sealed in weld region 146 after their respective channel has been inflated. Alternatively, more than one port can be sealed with a single weld. U.S. Pat. No. 5,832,630 to Potter, incorporated herein by reference, discloses a method of making a bladder using plural inflation ports. Inner channel 130 extends from inflation region 140 toward the rear of bladder 100. Channel 130 has its largest volume in the center of the heel region. Inner channel 131 extends in both the forefoot and heel regions of bladder 100 to replenish the fluid pressure and provide additional cushioning within both regions. In the forefoot, channel 131 extends along the lateral edge of bladder 100. In the heel, channel 131 follows the outline of a portion of channel 130 and extends along the medial and lateral sides of bladder 100.

Channel 132 creates a forefoot cushioning region surrounding the ball of the foot and in the area where toe-off occurs. As with channel 131, channel 132 can be provided with additional or extended welds 155 where it is desirable not to have a high pressure fluid channel, such as in area 141, to prevent the user from experiencing discomfort due to its high pressure and related lack of flexibility. A majority of channel 133 extends in the medial/lateral direction in the forward portion of the midfoot.

As discussed above with respect to bladder 10, sheets 111 and 112 are formed of a material and of a thickness that exhibits a suitable GTR which allows gas to diffuse from channels 130–133 into chambers 122 and 123 to counteract the diffusion that occurs through sheets 116 and 117. By allowing gas, such as nitrogen, to diffuse from channels 130–133, a predetermined level of pressure can be maintained or re-established in chambers 122 and 123, as discussed above with respect to chambers 15 and 18 of bladder 10. Alternatively, sheets 111 and 112 are formed of a material that will fail in response to an applied load or after a predetermined period of use. This creates instantaneous re-pressurization of chambers 122 and 123 in response to a predetermined occurrence, as discussed above with respect to sheets 11 and 12 of bladder 10.

As illustrated in FIGS. 18 to 21, each of the above discussed embodiments can also include one or more gas filled members 200 for replenishing the pressure level within any chamber. For example, members 200 can be included in reservoir chamber 14 or 114 for replenishing their pressure after the nitrogen has diffused out into the surrounding chambers. Alternatively, members 200 can be located within chambers 15, 18, 122 and 123 for supplementing the re-pressurization provided by chambers 14 and 114. Gas filled members, or pellets, 200 have a very high internal pressure, relative to the pressure levels in chambers 15 and 18, that is released when their barrier sheets are ruptured. The pressure can be on the order of 80 to 120 PSI, with a preferred pressure being between 95 and 105 PSI. The volume and internal pressure of pellets 200 are chosen based on the volume of the chamber in which they are enclosed and the desired resulting pressure therein after pellet 200 ruptures. Pellets are formed of materials such as aluminum, hard plastics, MYLAR, or PVDC (Saran), that resist rupturing during normal foot strikes when chambers 15 and 18 are at the desired pressure. Instead, only an excessively high amount of force directly applied to pellet 200 will rupture it. This occurs when the pressure in outer chambers 15 and 18 become low enough for the force of foot impact to cause chamber 13 to be compressed sufficiently to rupture pellets 200.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

We claim:

1. A bladder for an article of footwear, the bladder comprising:

a first chamber formed of a first barrier material, the first chamber being sealed to enclose a first fluid; and a second chamber formed of a second barrier material that is different than the first barrier material, the second chamber being sealed to enclose a second fluid, and the second chamber being at least partially located within the first chamber, at least one of the second barrier material, the second fluid, and a pressure of the second chamber being selected such that the second fluid transfers into the first chamber to increase a pressure of the first chamber and decrease the pressure of the second chamber, and the second barrier material is structured so that the first fluid diffuses out of the second chamber and into the first chamber at a predetermined rate.

2. The bladder recited in claim 1, wherein the first fluid includes nitrogen.

3. A bladder for an article of footwear, the bladder comprising:

a first chamber formed of a first barrier material, the first chamber being sealed to enclose a first fluid;

a second chamber formed of a second barrier material that is different than the first barrier material, the second chamber being sealed to enclose a second fluid, and the second chamber being at least partially located within the first chamber, a pressure of the second chamber being greater than a pressure of the first chamber, and the second fluid and the second barrier material being selected such that at least a portion of the second fluid diffuses from the second chamber to the first chamber to increase the pressure of the first chamber and decrease a pressure of the second chamber, and the diffusion of the second fluid from the second chamber to the first chamber occurs at a predetermined rate.

4. A bladder for an article of footwear, the bladder comprising:

a first chamber formed of a first barrier material, the first chamber being sealed to enclose a first fluid;

a second chamber formed of a second barrier material that is less durable than the first barrier material, the second chamber being sealed to enclose a second fluid, and the second chamber being at least partially located within the first chamber, the second chamber including a preformed weakness in the second barrier material that is structured to experience fatigue failure following a predetermined number of cycles of compression or flex to transfer the second fluid into the first chamber and increase a pressure of the first chamber and decrease a pressure of the second chamber.

5. The bladder recited in claim 4, wherein the second barrier material is more brittle than the first barrier material.

6. A bladder for an article of footwear, the bladder comprising:

a first chamber formed of a first barrier material, the first chamber being sealed to enclose a first fluid at a first pressure;

a second chamber formed of a second barrier material that is different than the first barrier material, the second chamber being sealed to enclose a second fluid at a second pressure that is greater than the first pressure, and the second chamber being located within the first chamber, the bladder having a structure wherein the first fluid diffuses trough the first barrier material and out of the bladder, and the second barrier material and the second fluid are selected so that the second fluid diffuses through the second barrier material and into the first chamber to increase the first pressure and decrease the second pressure.

7. The bladder recited in claim 6, wherein the diffusion of the second fluid from the second chamber to the first chamber occurs over a predetermined period of time.

8. A bladder for an article of footwear, the bladder comprising:

a first chamber formed of a fist barrier material, the first chamber being sealed to enclose a first fluid at a first pressure;

a second chamber formed of a second barrier material that is different than the first barrier material, the second chamber being sealed to enclose a second fluid at a second pressure that is greater than the first pressure, and the second chamber being located within the first chamber, the second barrier material having a structure that is more brittle than the first barrier material so that the second chamber experiences fatigue failure following a predetermined number of cycles of compression or flex and transfers the second fluid into the first chamber to increase the first pressure and decrease the second pressure, and the second chamber includes a preformed weakness in the second barrier material.

9. A bladder for an article of footwear, the bladder comprising:

a first chamber formed of a first barrier material, the first chamber being sealed to enclose a first fluid; and a second chamber formed of a second barrier material that is different than the first barrier material, the second chamber being sealed to enclose a second fluid, and the second chamber being at least partially located within the first chamber, at least one of the second barrier material, the second fluid, and a pressure of the second chamber being selected such that the second fluid transfers into the first chamber to increase a pressure of the first chamber and decrease the pressure of the second chamber, and the second chamber includes a preformed weakness in the second barrier material.

10. The bladder recited in claim 9, wherein the second barrier material is structured to release the second fluid to the first chamber by fatigue failure of the second barrier material.

11. The bladder recited in claim 9, wherein the second barrier material is more brittle than the first barrier material.

12. A bladder for an article of footwear, the bladder comprising:

a first chamber formed of a first barrier material, the first chamber being sealed to enclose a first fluid;

a second chamber formed of a second barrier material that is different than the first barrier material, the second chamber being sealed to enclose a second fluid, and the second chamber being at least partially located within the first chamber; and a valve in the second chamber and a valve actuator, at least one of the second barrier material, the second fluid, and a pressure of the second chamber being selected such that the second fluid transfers into the first chamber to increase a pressure of the first chamber and decrease the pressure of the second chamber, and the second chamber releases the second fluid to the first chamber by manual actuation of the valve actuator.

13. A bladder for an article of footwear, the bladder comprising:

a first chamber formed of a first barrier material, the first chamber being sealed to enclose a first fluid;

a second chamber formed of a second barrier material that is different than the first barrier material, the second chamber being sealed to enclose a second fluid, and the second chamber being at least partially located within the first chamber; and a puncturing structure adjacent the second chamber for manually puncturing the second chamber to release the second fluid to the first chamber such that the second fluid transfers into the first chamber to increase a pressure of the first chamber and decrease the pressure of the second chamber, and the second chamber releases the second fluid to the first chamber by manual actuation of the puncturing structure.

14. A bladder for an article of footwear, the bladder comprising:

a first chamber formed of a first barrier material, the first chamber being sealed to enclose a first fluid; and a second chamber formed of a second barrier material that is different than the first barrier material, the second chamber being sealed to enclose a second fluid, and the second chamber being at least partially located within the first chamber, at least one of the second barrier material, the second fluid, and a pressure of the second chamber being selected such that only a portion of the second fluid is released to and transfers into the first chamber to increase a pressure of the first chamber and decrease the pressure of the second chamber.

15. The bladder recited in claim 14, wherein at least one of the first chamber and the second chamber includes a gas-filled member.

16. The bladder recited in claim 15, wherein the gas-filled member includes a barrier material that ruptures in response to an application of a predetermined pressure.

17. The bladder recited in claim 16, wherein a fluid pressure within the gas-filled member is greater than the pressure of the second chamber.

18. The bladder recited in claim 14, wherein the second chamber includes a plurality of fluid channels.

19. The bladder recited in claim 18, wherein each of the fluid channels includes a fluid inlet port adjacent a fluid inlet port of another one of the second chamber.

* * * * *